US005273082A

United States Patent [19]

Paasche et al.

[11] Patent Number: 5,273,082

[45] Date of Patent: Dec. 28, 1993

[54] METHOD AND APPARATUS FOR FILLING CONTAINERS

[75] Inventors: Siegfried Paasche, Hille; Gerald Raabe, Lübbecke, both of Fed. Rep. of Germany

[73] Assignee: Seitz Enzinger Noll Maschinenbau Aktiengesellschaft, Mannheim, Fed. Rep. of Germany

[21] Appl. No.: 889,793

[22] Filed: May 27, 1992

[30] Foreign Application Priority Data

May 27, 1991 [DE] Fed. Rep. of Germany ..... 4117287

[51] Int. Cl.[5] ..... B67C 3/08

[52] U.S. Cl. ..... 141/6; 141/39; 141/83; 141/147; 141/177; 141/266

[58] Field of Search ..... 141/1, 4, 5, 6, 39, 141/40, 83, 144, 147, 167, 177, 266

[56] References Cited

U.S. PATENT DOCUMENTS

| | | | |
|---|---|---|---|
| 4,557,301 | 12/1985 | Jorss | 141/5 |
| 4,635,688 | 1/1987 | Graffin | 141/1 |
| 4,807,673 | 2/1989 | Tazuke et al. | 141/5 X |
| 4,972,882 | 11/1990 | Kohashi | 141/1 |
| 5,016,684 | 5/1991 | Clusserath | 141/6 |
| 5,067,531 | 11/1991 | Herzos | 141/116 |
| 5,156,200 | 10/1992 | Mette | 141/46 |

*Primary Examiner*—Ernest G. Cusick
*Attorney, Agent, or Firm*—Robert W. Becker

[57] ABSTRACT

A method and apparatus for filling containers with a liquid material. The filling machine has a plurality of filling elements that form filling stations. At least one filling station is provided with a flowmeter that cooperates with a control device. On the basis of measurement data delivered by the flowmeter, the control device forms a control value that is used to control the filling stations that do not have a flowmeter.

38 Claims, 3 Drawing Sheets

METHOD AND APPARATUS FOR FILLING CONTAINERS

BACKGROUND OF THE INVENTION

The present invention relates to a method and apparatus for filling bottles, cans or similar containers with a prescribed quantity of a liquid material. The filling machine has a plurality of filling stations, each with a filling element having a liquid flow valve controlled by an actuating mechanism. The liquid flow valve is disposed in a liquid channel that forms a part of a material or product path and that has a dispensing or discharge opening via which the liquid material, during a filling phase with the liquid flow valve open, flows to a container that is positioned below the filling element. The filling machine also has an electrical control device that cooperates with the actuating mechanisms of the filling elements. To terminate a filling phase the control device delivers to a pertaining actuating mechanism a signal that effects closing of the liquid flow valve and that is a function of a measured value that is delivered by a flowmeter that is disposed in the product path, with the measured value corresponding to the quantity of material that has actually flowed to the container via the pertaining filling element, and with the control device also taking into consideration, for termination of the filling phase, the prescribed quantity of material that is to be dispensed into the container.

A method is known for filling bottles, cans or similar containers, i.e. for controlling an appropriate filling machine, from U.S. Pat. No. 4,557,301. With this known method, the dispensing of a prescribed quantity of filling material into bottles is controlled by associating a flowmeter with each filling station. This flowmeter delivers a measured value that is proportional to the quantity of material that has flowed to the respective bottle during the filling phase. This measured value is compared with a theoretical value in a control device. The filling phase is then terminated by closing the pertaining liquid flow valve if the measured value delivered by the flowmeter is equal to the setpoint value.

With this known method or filling machine, a flowmeter is associated with each filling element or filling section. This means that if a central control device is used, then in particular at a high output of the filling machine, a large amount of data is generated and must be processed in short time intervals. Such a central control device must therefore be designed to be extremely efficient. In addition to the already high cost that results from using a separate flowmeter for each filling station, an expensive central control device is therefore also necessary. In place of a central control device, it would also be possible to use a decentralized control for the individual filling elements by associating a separate control device with each filling element for the theoretical value/actual value control. However, this again means high cost due to the great capital outlay in control electronics. Furthermore, such a decentralized control makes it more difficult to input and/or take into consideration common parameters for improving or optimizing the filling process.

It is an object of the present invention to further improve a method and filling machine of the aforementioned general type in such a way that while maintaining the fundamental advantages of the prior art, it is possible to achieve a considerable reduction in the capital outlay for control purposes.

SUMMARY OF THE INVENTION

The method and apparatus of the present invention are characterized primarily in that: At least one of the filling elements is provided with a flowmeter and is designated as a master filling station; at least one further filling element has no flowmeter and is designated as a slave filling station that is associated with the master filling station; on the basis of the measured value delivered by the flowmeter of the master filling station, the control device determines a control value that corresponds to a filling time required by the master filling station to achieve the prescribed quantity of material; and, via appropriate control signals, the control device effects an opening of the liquid flow valve of the filling element of the at least one associated slave filling station during a period of time or opening time derived from the control signals.

Pursuant to the present invention, a filling station having a flowmeter in the product path is respectively associated with at least one filling station that does not have such a flowmeter, whereby from the filling time determined for the filling station (master filling station) having the flowmeter until the prescribed quantity of filling material is achieved, a control value is derived that determines the opening time of the associated filling station (slave filling station) that has no flowmeter, so that already with only one slave filling station associated with a single master filling station, the amount of information that is produced per unit of time can be cut in half. This results in a considerable simplification not only with regard to the hardware necessary for the control mechanisms, but rather above all with respect to the data processing and/or data management. In this connection, a basis of the present invention is that without changing the design of the filling elements, even at the slave filling stations, despite the fact that no measurement of flow takes place at those locations, it is possible to fill containers at these locations in a manner that is just as precise as at the master filling stations that have measurement of through-flow, since all of the filling elements can be constructed the same and the time intervals in which the control value or opening time are determined, and in which the opening and closing of the slave filling stations is effected, is so short that changes in the filling parameters that could adversely affect the filling results cannot occur or become effective.

Further specific features of the present invention will be described in detail subsequently.

BRIEF DESCRIPTION OF THE DRAWINGS

The objects and advantages of the present invention, will appear more clearly from the following specification in conjunction with the accompanying schematic drawings, in which.

DESCRIPTION OF PREFERRED EMBODIMENTS

Figure 1:
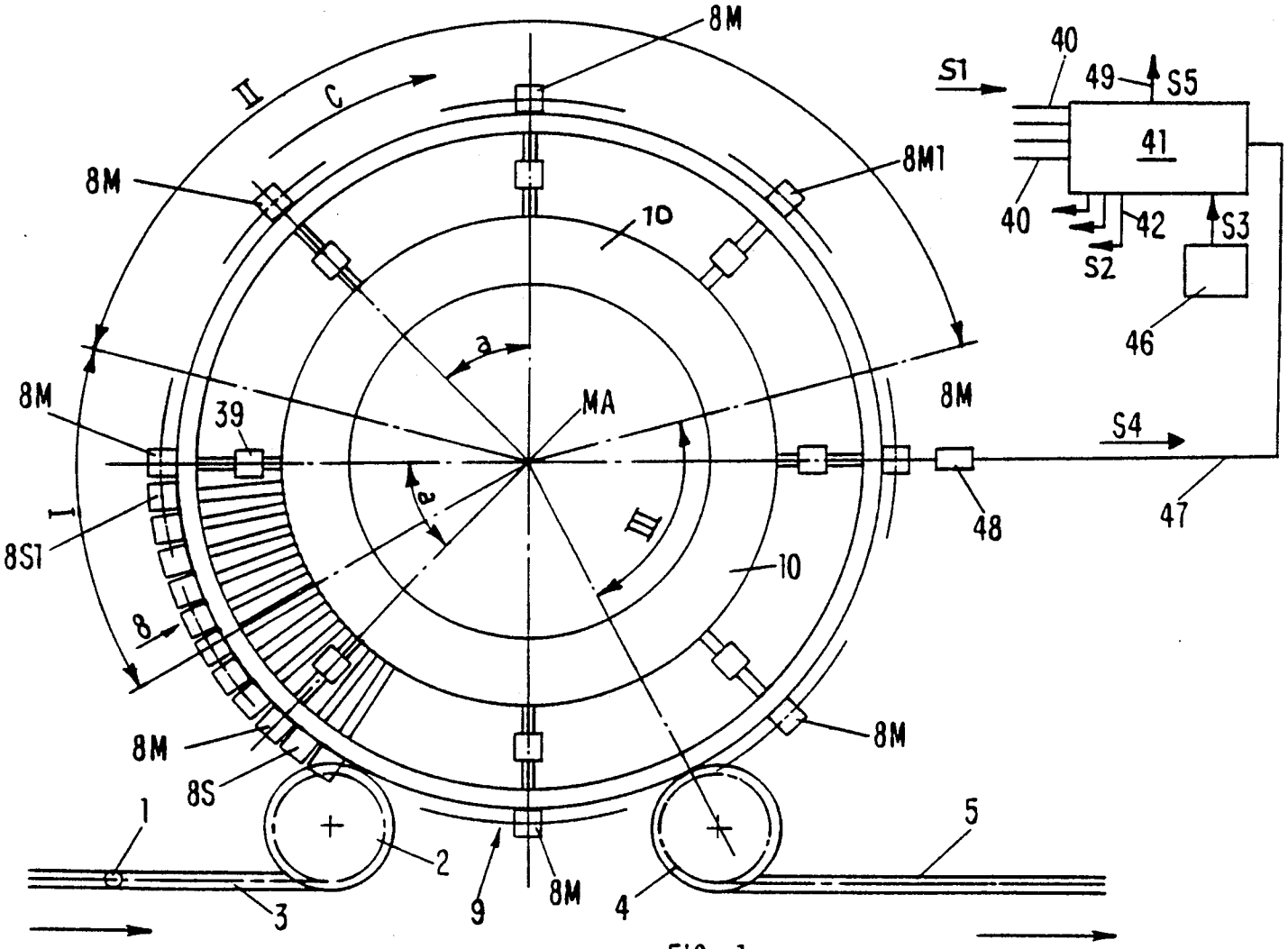
FIG. 1 is a simplified plan view of one exemplary embodiment of the filling machine of the present invention in the form of a can-filling machine having a plurality of filling elements that are provided at the periphery of a rotating machine component, with some of the filling elements forming leading or master filling stations, and with another portion of the filling elements forming following or slave filling stations.

Referring now to the drawings in detail, the illustrated embodiment involves a counterpressure filling machine for filling the containers 1, in this case cans, with a carbonated liquid material, such as beer. The empty cans 1 are supplied to the filling machine, i.e. to a transfer star 2 that forms an inlet of this filling machine, via a conveyor means 3. The filled cans leave the filling machine at an outlet via a transfer star 4 and are conveyed with the requisite spacing via a conveyor means 5 to a subsequently provided closure or sealing machine.

Figure 2:
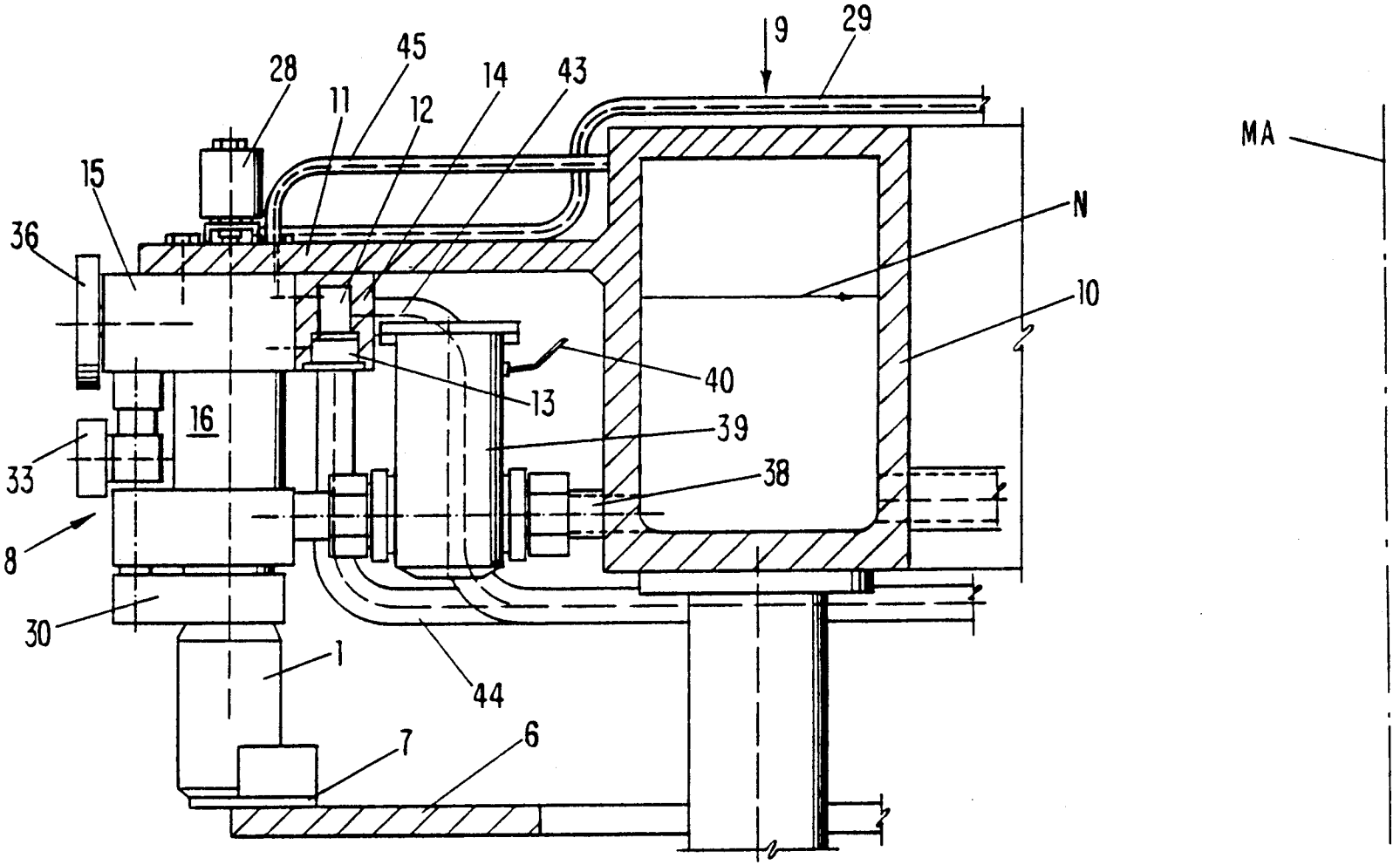
FIG. 2 is a simplified cross-sectional view through a portion of the machine of FIG. 1.
Figure 3:
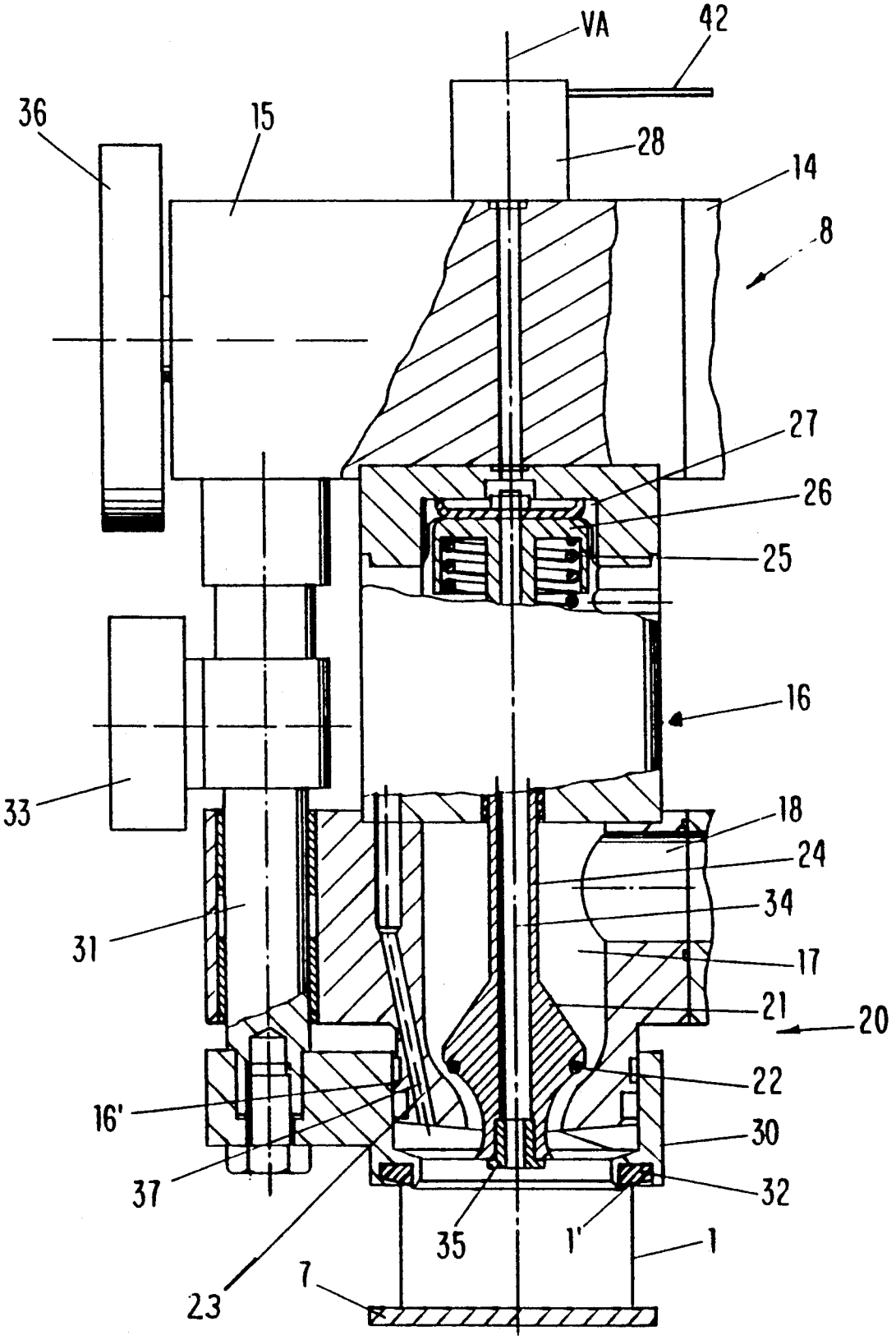
FIG. 3 is a simplified longitudinal cross-sectional view through one of the filling elements, along with a can that is disposed below this filling element.

By means of the transfer star 2, each can 1 passes in a conventional manner at the inlet onto one of the support surfaces 7 that are provided on a ring 6 (see FIG. 2). This takes place in such a way that each can 1, the base of which rests upon a support surface 7, is disposed below a filling element 8. The ring 6 forms a lower portion of the rotor of the filling machine, which rotates about a vertical machine axis MA in the direction of the arrow C. The filling elements 8 are spaced uniformly apart on a machine component 9 that is disposed above the ring 6 and also rotates about the vertical machine axis MA. The machine component 9 is essentially formed by an annular tank 10 and an annular flange 11 that, relative to the machine axis MA, projects radially outwardly from the tank 10. Provided on the flange 11, in addition to the filling elements 8, is a ring 14 that forms a pressurizing gas channel 12 and a relief or venting channel 13. The ring 14 concentrically surrounds the annular tank 10 and is directly connected to a control unit 15 of the filling elements 8, i.e. to connections for the pressurizing gas and for the venting that are provided at that location. Each filling element 8, which is connected to the control unit 15 on the underside of the flange 11, includes a housing 16 that is comprised of many parts. The housing 16 has a liquid channel 17 that is formed in the lower portion of the housing 16 and extends essentially concentrically relative to a vertical filling element axis VA that extends parallel to the machine axis MA; the liquid channel 17 forms a portion of the path of the product or material that is being filled. In the vicinity of its upper, closed end, the liquid channel 17 has an inlet opening for the supply of the liquid material. At the lower end of the housing 16, the liquid channel 17 forms a dispensing or discharge opening 19 through which the liquid material flows to the respective can 1 during a filling process. Also provided in the liquid channel 17 is a valve body 21 that forms the liquid flow valve 20. The valve body 21 has an annular seal means 22 that, when the liquid valve 20 is closed, rests sealingly against a valve surface or seat 23 that is formed by the outer surface of the liquid channel 17. In FIG. 3, the liquid flow valve 20 is illustrated in the open position, in which the liquid material can flow to the can 1 that is to be filled via the liquid channel 17 and the annular discharge opening 19 that surrounds the lower end of the valve body 21. By lowering the valve body 21 in the direction of the filling element axis VA, the liquid flow valve 20 is closed. The valve body 21 is disposed at the lower end of a push rod 24 that is guided in the housing 16 in such a way that it can shift in a direction coaxial with the filling element axis VA. Above the liquid channel 17, the push rod 24 is disposed in the housing 16 in such a way as to be sealed relative to the liquid channel. The upper end of the push rod 24 cooperates with a control means via which in the illustrated embodiment the liquid flow valve 20 can be moved out of the open position illustrated in FIG. 3, against the force of a spring 25, into a closed position. In the illustrated embodiment, this control means is a pneumatic piston/cylinder arrangement that includes a piston 26 and a control chamber 27 that is formed in the interior of the housing 16. The control chamber 27 is bounded on one side by the piston 26, which can be shifted in the direction of the filling element axis VA. By means of the control unit 15, compressed air, i.e. a pneumatic pressure, can be supplied to the control chamber 27 of each filling element 8 for closing the liquid flow valve 20. This is effected in a controlled manner via a pneumatic unit, in the illustrated embodiment an electrically actuatable control valve 28. One such actuating or control valve 28 is provided for each filling element 8, and in particular is disposed above the respective filling element 8 on the upper side of the flange 11. Compressed air is supplied to the respective control valve 28 via a control or compressed air line 29.

Sealingly disposed on a circular cylindrical portion 16' at the lower end of the housing 16 is a ring 30 that surrounds the portion 16' and that can be shifted in the direction of the filling element axis VA. To prevent the ring 30 from turning, this ring is connected to the lower end of a guide rod 31 that is disposed parallel to the filling element axis VA and is displaceably guided in the housing 16 The lower end face of the ring 30, where the ring is open, is provided with a sealing ring 32 that surrounds the ring opening. During pressurization and filling of a can 1, the sealing ring 32 is pressed against the rim 1' thereof. Disposed on the guide rod 31 is the conventional roller 33 that cooperates with a fixed guide curve or cam for raising the ring 30.

Formed within the push rod 24 is a channel 34 that is open at the bottom end of the valve body 21 where it extends beyond the discharge opening 19. In particular, the channel 34 is open via the opening of an exchangeable restrictor or nozzle 35 that is provided at that location. The other end of the channel 34 communicates with the control valve mechanism or slide control that is provided in the control unit 15. This control valve mechanism or slide control is provided in the manner known for filling elements with a control or sequence switch cam 36 that, as the machine component 9 rotates, cooperates with stationary switching and actuating elements, and in particular in such a way that during pressurization of the respective can 1, which precedes the actual filling phase, during which pressurization the rim 1' of the can 1 rests sealingly against the sealing ring 32, the pressurizing gas is supplied via the channel 34; in contrast, during the filling phase the channel 34 acts as a return gas channel, and at the end of the filling process the channel S4 serves for venting the respective can 1.

To rinse the cans 1, i.e. the interior of these cans, with an inert gas, such as $CO_2$ gas, each filling element S is additionally provided with a channel 37 that at the lower end of the housing 16 has a discharge opening for this inert gas. Control of this preliminary rinsing via inert gas is again effected by the slide control that is provided in the control unit 15 and via the sequence switch cam S6 and the associated fixed actuating elements.

Most of the inlet openings 18 of the filling elements 8, which are all identical, communicate directly with an outlet 38 that is respectively provided near the base of the annular tank 10, which is filled with the liquid material to a prescribed level N. However, the inlet openings 18 of some of the filling elements 8 communicate with the appropriate outlet 38 of the annular tank 10 via the interposition of a respective flowmeter 39. These flowmeters 39, which in the illustrated embodiment are inductive flowmeters, deliver electrical signals S1 via measurement or data lines 40. The value of these signals S1 correspond to the rate or quantity of flow, i.e. to the volume of liquid material that flows through the pertaining flowmeter per unit of time. These electrical signals or measurement data are, for example, metering pulses, each of which corresponds to a specific unit of volume, or can be digital values delivered by a counter of the respective flowmeter 39. The flowmeters 39 are connected via the data lines or buses 40 to a central control and regulating device 41, which, for example, has a programable microprocessor or is part of a computer system and is disposed on the rotating machine component 9.

As illustrated in FIG. 1, the filling elements 8 are that are provided with the flowmeters 39 and that form leading or master filling stations $8_M$, are distributed about the machine axis MA at uniform angular spacings "a", and in particular in such a way that a number of filling elements 8 that have no flowmeter 39 are disposed between two filling elements 8 that are provided with flowmeters 39 and that follow one another in the direction of rotation C of the machine. These filling elements 8 that have no flowmeter 39 form following or slave filling stations $8_S$. In the illustrated embodiment, eight such slave filling stations 8S are associated with a master filling station $8_M$, with each of the latter forming a group of eight filling stations $8_S$. For reasons that will be discussed in detail subsequently, this association is such that each master filling station $8_M$ is associated with a group of slave filling stations $8_S$ that, relative to the direction of rotation C, lag behind or follow their master filling station $8_M$ by at least one angular spacing "a", and preferably by several angular spacings "a". For example, in the illustrated embodiment the slave filling stations $8_{S1}$ are associated with the master filling stations $8_{M1}$.

The control device 41 has a plurality of outlets, each of which is connected via a control line 42 to a control valve 28 and activates the latter.

Also shown in the drawings are a conduit 43 for supplying the pressurizing gas to the annular pressuring gas channel 12, a conduit 44 that communicates with the annular relief channel 13, and a conduit 45 that opens into the space formed above the level N and via which displaced return gas is conveyed into this space of the annular tank during the filling process.

The filling machine operates as follows:

After a can 1 that is to be filled has been delivered by the transfer star 2 to a filling station 8 or $8_S$ formed by a filling element 8, and during rotation of the machine, i.e., the rotor thereof, this can 1, after a possible rinsing and lowering of the respective ring 30 onto the can, is first pressurized with the pressurizing gas in an angular range of the rotational movement designated as I in FIG. 1. After conclusion of this pressurization, and after an appropriate switching-over of the slide control provided in the control unit 15 as a result of the sequence switch cam 36 running up against a stationary control element, there is then effected at the end of the angular range or zone I, the initiation or preparation of the filling phase via the control device 41. The angular zone of the rotational movement of the machine component 9 indicated by II in FIG. 1 is provided for the filling phase. Until the angular zone II has been reached, the liquid flow valve 20 of the respective filling element 0 is closed, i.e. the control chamber 27 of this filling element 8 is supplied with the control pressure. As soon as a filling element 8 that is provided with a can 1 reaches the beginning of the angular zone II, the control device 41, via the pertaining control line 42, actuates the control valve 28 associated with this filling element S for opening the liquid flow valve 20. In other words, the control valve 28 is actuated in such a way that the communication of the control chamber 27 with the control compressed air is interrupted and this control chamber is vented to the atmosphere. After an opening time T' prescribed by the control device 41 has expired, there is again effected via the control line 42 an actuation of the control valve 28 for closing the liquid flow valve 20 of the pertaining filling element 8. The opening time T' is such that the liquid flow valve 20 of the pertaining filling element 8 is already closed before this filling element has reached the end of the angular zone II. In the subsequent angular zone III, after appropriate actuation of the slide control provided in the control unit 15, there is then effected a relieving or depressurizing of the respective filled can 1 and the filling element 8, i.e. the ring 30, is withdrawn from the filled can.

In the illustrated embodiment, the opening time T' that is necessary for filling the respective can 1 with the desired quantity of material is determined by the control device 41 on the basis of the measurement data S1 delivered from the flowmeters 39 via the measurement or data lines 40. In other words, for a pertaining filling station a master filling station $8_M$ is involved, so that after opening of the liquid flow valve 20, i.e. after appropriate activation of the control valve 28, the quantity of liquid material flowing through the pertaining flowmeter 39 is monitored by the control device 41 and is compared with a prescribed or preselected theoretical or desired value for the quantity of material that is to be filled into the cans 1. As soon as the quantity of filling material measured by the flowmeter 39 corresponds to the theoretical value, the control device 41, via appropriate actuation of the control valve 28, closes the liquid flow valve 20 of the filling element 8 of the pertaining master filling station $8_M$. The entire opening time of the liquid flow valve 20 of the master filling station $8_M$ is stored as a control value or filling time T for the filling elements 8 of the slave filling stations $8_S$ that are associated with the pertaining master filling station $8_M$. As soon as such a slave filling station $8_S$ has reached the beginning of the angular zone II, the liquid flow valve 20 of this filling station $8_S$ is opened for a period of time that is equal to this filling time T. The filling time T that is stored in the control device 41 is also applicable for the subsequent slave filling stations $8_S$, relative to the direction of rotation C of the filling machine, associated with a master filling station $8_M$, so that a respective filling time T is stored for each master filling station $8_M$ and the pertaining slave filling stations $8_S$.

However in principle it is also possible to store only a single filling time T in the storage or control device 41, with this single filling time being applicable for all of the slave filling stations $8_S$ that follow a master filling station $8_M$ and that is respectively updated taking into consideration the measurement data delivered by the flowmeter 39 of a master filling station $8_M$, and in particular the measurement data S1 that after closing of the liquid flow valve 20 are delivered from that master filling station $8_M$ that, at a particular point in time in the angular zone II, and relative to the direction of rotation C, is the respectively last master filling station $8_M$ having an again closed liquid flow valve 20.

Regardless of whether a plurality of filling times T are respectively separately stored for the individual master filling stations $8_M$ and the pertaining slave filling stations $8_S$, or whether only a single filling time T that is updated in the aforementioned manner is stored, it is advantageous that prior to start-up of the filling machine, the filling times T or control values be preselected or preset in conformity with the desired quantity of filling material, and that these filling times or control values then be corrected or updated merely on the basis of the signals S1 delivered by the flowmeters 39.

The control device 41 is connected with an input means or keyboard 46 for the input of starting values of the filling time or times T, in other words for the input of the desired quantity of filling material, from which the control device 41 then automatically determines an output value for the filling time T, as well as for the input of further parameters or data S3 that are necessary for controlling the filling machine.

The control device 41 is furthermore connected to a signal emitter 48 via a data line 47. The signal emitter 48 transmits to the control device 41 the respective rotational position of the machine, i.e. of the rotor formed by the ring 6 and the machine component 9, as well as the rotational speed as electrical data S4.

In particular also taking into consideration the data S4 delivered by the signal emitter 48 a further control is possible in that the control device 41 delivers a signal S5 at an output 49 if within a prescribed angular range of the rotational movement of the machine, for example within the angular range or zone II, in other words within a prescribed maximum range for the filling time, an actual value for the signal S1 that corresponds to the desired quantity of filling material cannot be achieved. By means of the signal S5 then for example, the rotational speed of the machine is reduced and/or the level N of the liquid material in the annular tank 10 is increased and/or the filling pressure is increased and/or another parameter is altered in such a way that the quantity of liquid material dispensed at the individual filling elements 8 per unit of time is increased.

In order to be able to carry out the aforementioned control of the filling machine with the required precision relative to the quantity of material respectively filled into the cans 1, it is in particular necessary that all of the filling elements 8 respectively ensure the same flow-in speed for the liquid material into the cans 1 that are to be filled. Since the respective filling speed is in particular also a function of the resistance in the return gas path, with the illustrated embodiment an adjustable restrictor is provided in the return gas path of these filling elements 8 to equalize the filling speeds of the individual filling elements 8; the restrictor is respectively formed by the exchangeable nozzle 35.

In principle, an adjustable restrictor could also be provided in the product path in addition to an adjustable restrictor in the return gas path or in place thereof.

The present invention has been described in conjunction with one specific embodiment. However, it is to be understood that alterations and modifications are possible without thereby straying from the basic concept of the invention. For example, it is possible to have only a single master filling station instead of a plurality of master filling stations $8_M$. With this single master filling station then also for all of the rest of the filling stations the filling time is fixed or respectively corrected or updated. It is furthermore also possible, on the basis of the signal S1 delivered from a flowmeter 39, to determine other times in addition to the filling time T, and in particular, for example, times which during the filling result in a change of the in-flow speed of the liquid material via appropriate control signals to the filling elements 8.

In principle, it is possible during opening and closing of the liquid flow valves 20 of the filling elements 8 to also utilize a correction value that takes into account changes in the limiting factors upon the flow velocity and that together with the determined control value or filling time T delivers the opening time T'. It is also possible, for example, to utilize as a correction value a signal that is delivered by a testing device that is disposed at the outlet of t he filling machine. This testing device can, for example, be a weighing device or a device for measuring the filling level in the filled cans 1.

In principle, control of the filling machine can also be effected in such a way that during each rotation of the machine, i.e. of the machine component 9, the control values or filling times T of a preceding rotation are utilized. In particular, in this situation it is possible to associate with the respective master filling stations 8M the immediately following slave filling stations $8_S$ as viewed in the direction of rotation C.

The present invention is, of course, in no way restricted to the specific disclosure of the specification and drawings, but also encompasses any modifications within the scope of the appended claims.

What we claim is:

1. In a method of filling containers with a prescribed quantity of a liquid material using a filling machine that has a plurality of filling stations, each with a filling element having a liquid flow valve controlled by an actuating mechanism, with said liquid flow valve being disposed in a liquid channel that forms a part of a material or product path and that has a discharge opening via which said liquid material, during a filling phase with said liquid flow valve open, flows to a container that is positioned below said filling element, with said filling machine also having an electrical control device that cooperates with said actuating mechanisms of said filling elements, whereby to terminate a filling phase said control device delivers to a pertaining actuating mechanism a signal that effects closing of said liquid flow valve and that is a function of a measured value that is delivered by a flowmeter that is disposed in said product path, with said measured value corresponding to the quantity of material that has actually flowed to said container via the pertinent filling element, and with said control device also taking into consideration, for termination of said filling phase, said prescribed quantity of material that is to be dispensed into said container, the improvement including the steps of:

providing at least one of said filling elements with a flowmeter and designating said at least one filling element as a master filling station;

providing at least one further filling element that has no flowmeter and designating said at least one further filling element as a slave filling station;

associating said slave filling station with said master filling station;

determining with said control device, on the basis of said measured value delivered by said flowmeter of said master filling station, a control value that corresponds to a filling time required by said master filling station to achieve said prescribed quantity of material; and effecting with said control device, via appropriate control signals, an opening of said liquid flow valve of said filling element of said at least one associated slave filling station during a period of time or opening time derived from said control signals.

2. A method according to claim 1, in which said control value is said filling time.

3. A method according to claim 1, in which said control value determined by said control device is equal to said opening time of said liquid flow valve of said slave filling station.

4. A method according to claim 1, in which said opening time of said liquid flow valve of said slave filling station is formed from said control value of said control device taking into consideration a correction value that takes into consideration, for example, changes in limiting values of the flow velocity of said liquid material and/or fluctuations of said prescribed quantity of said liquid material that is to be dispensed into said container, with said fluctuations being determined in a testing device.

5. A method according to claim 1, which includes the step of effecting opening of said liquid flow valve of said slave filling station only after said liquid flow valve of the associated master filling station is closed.

6. A method according to claim 5, which includes the step of opening said liquid flow valve of said slave filling station in a time-delayed manner after closing of said liquid flow valve of said master filling station.

7. A method according to claim 6, which includes the steps of using a rotating-type filling machine having a plurality of filling stations that are disposed at the periphery of a machine component that rotates in a given direction of rotation about a vertical machine axis, and having at least one of said filling stations form a master filling station and the other filling stations form slave filling stations, whereby said slave filling stations which are associated with said at least one master filling station follow the latter when viewed in said direction of rotation.

8. A method according to claim 7, which includes the steps of distributing at least two master filling stations about said periphery of said machine component at prescribed angular spacings, preferably uniform angular spacings, and disposing at least one slave filling station between each two master filling stations.

9. A method according to claim 8, in which said at least one slave filling station immediately follows its master filling station.

10. A method according to claim 8, in which said at least one slave filling station associated with a master filling station is offset by at least one of said angular spacings.

11. A method according to claim 1, in which said control device determines said control value taking into consideration further filling parameters such as filling pressure, type and temperature of said liquid material, and size and shape of said container.

12. A method according to claim 1, in which said control device, in addition to generating at least one control value for controlling said filling elements, generates other control signals for setting and/or altering a velocity at which said liquid material flows to a respective container during a filling phase.

13. A method according to claim 1, in which said control device delivers an additional control or output signal if within a prescribed maximum time interval, or within a prescribed maximum angular range of said rotational movement of said machine component, a measured value conforming to said prescribed filling quantity is not achieved by said flowmeter of said at least one master filling station.

14. A method according to claim 1, which includes the step of manually setting or adjusting the velocity at which said liquid material flows to a respective container during a filling phase by adjusting a restrictor means disposed in said product path or a return gas path of said filling elements.

15. A method according to claim 1, which includes the step of providing a plurality of master filling stations each having at least one associated slave filling station, whereby said control device determines a separate control value for each master filling station with its pertaining slave filling stations.

16. A method according to claim 1, which includes the step of providing a plurality of master filling stations each having at least one associated slave filling station, whereby said control device determines a control value that is common for all of said slave filling stations and that is respectively updated by said measured value of said flowmeters of said master filling stations.

17. A method according to claim 1, which includes the step of automatically initiating a filling phase for a respective filling station when a container is present if said filling station has reached a specific angular position during rotation of said rotating machine component.

18. In a filling machine for filling containers with a prescribed quantity of a liquid material, said filling machine having a plurality of filling stations each With a filling element having a liquid flow valve controlled by an actuating mechanism, with said liquid flow valve being disposed in a liquid channel that forms a part of a material or product path and that has a discharge opening via which said liquid material, during a filling phase with said liquid flow valve open, flows to a container that is positioned below said filling element, with said filling machine also having an electrical control device that cooperates with said actuating mechanisms of said filling elements, whereby to terminate a filling phase said control device delivers to a pertaining actuating mechanism a signal that effects closing of said liquid flow valve and that is a function of a measured value that is delivered by a flowmeter that is disposed in said product path, with said measured value corresponding to the quantity of material that has actually flowed to said container via the pertinent filling element, and with said control device also taking into consideration, for termination of said filling phase, said prescribed quantity of material that is to be dispensed into said container, the improvement comprising:

at least one of said filling elements with a flowmeter and said at least one filling element as a master filling station;

at least one further filling element that has no flowmeter and said at least one further filling element as a slave filling station; and said slave filling station associated with said master filling station whereby said control device, on the basis of said measured value delivered by said flowmeter of said master filling station, determines a control value that corresponds to a filling time required by said master filling station to achieve said prescribed quantity of material, and whereby said control device, via appropriate control signals, effects an opening of said liquid flow valve of said filling element of said at least one associated slave filling station during a period of time or opening time derived from said control signals.

19. A filling machine according to claim 18, in which said control value is said filling time.

20. A filling machine according to claim 18, in which said control value determined by said control device is equal to said opening time of said liquid flow valve of said slave filling station.

21. A filling machine according to claim 18, in which said opening time of said liquid flow valve of said slave filling station is formed from said control value of said control device taking into consideration a correction value that takes into consideration, for example, changes in limiting values of the flow velocity of said liquid material and/or fluctuations of said prescribed quantity of said liquid material that is to be dispensed into said container, with said fluctuations being determined by a testing device disposed at an outlet of said filling machine.

22. A filling machine according to claim 18, in which said control device effects opening of said liquid flow valve of said slave filling station only after said liquid flow valve of the associated master filling station is closed.

23. A filling machine according to claim 22, in which opening of said liquid flow valve of said slave filling station is effected in a time-delayed manner after closing of said liquid flow valve of said master filling station.

24. A filling machine according to claim 23, in which said filling machine is a rotating-type filling machine having a plurality of filling stations that are disposed at the periphery of a machine component that rotates in a given direction of rotation about a vertical machine axis, and in which at least one of said filling stations forms a master filling station and the other filling stations form slave filling stations, whereby said slave filling stations which are associated with said at least one master filling station follow the latter when viewed in said direction of rotation.

25. A filling machine according to claim 24, in which at least two master filling stations are distributed about said periphery of said machine component at prescribed angular spacings, preferably uniform angular spacings, and at least one slave filling station is disposed between each two master filling stations.

26. A filling machine according to claim 25, in which said at least one slave filling station immediately follows its master filling station.

27. A filling machine according to claim 25, in which said at least one slave filling station associated with ,a master, filling station is offset by at least one of said angular spacings.

28. A filling machine according to claim 18, in which said control device determines said control value taking into consideration further filling parameters such as filling pressure, type and temperature of said liquid material, and size and shape of said container.

29. A filling machine according to claim 18, in which said control device, in addition to generating at least one control value for controlling said filling elements, generates other control signals for setting and/or altering a velocity at which said liquid material flows to a respective container during a filling phase.

30. A filling machine according to claim 18, in which said control device delivers an additional control or output signal if within a prescribed maximum time interval, or within a prescribed maximum angular range of said rotational movement of said machine component, a measured value conforming to said prescribed filling quantity is not achieved by said flowmeter of said at least one master filling station.

31. A filling machine according to claim 18, which includes means for manually setting or adjusting the velocity at which said liquid material flows to a respective container during a filling phase.

32. A filling machine according to claim 31, which includes an adjustable and/or exchangeable restrictor means disposed in said product path or a return gas path of each of said filling elements.

33. A filling machine according to claim 18, which includes a plurality of master filling stations each having at least one associated slave filling station, whereby said control device determines a separate control value for each master filling station with its pertaining slave filling stations.

34. A filling machine according to claim 18, which includes a plurality of master filling stations each having at least one associated slave filling station, whereby said control device determines a control value that is common for all of said slave filling stations and that is respectively updated by said measured value of said flowmeters of said master filling stations.

35. A filling machine according to claim 18, wherein said at least one flowmeter is an inductive flowmeter.

36. A filling machine according to claim 18, wherein said liquid flow value of a respective filling element is provided with a pneumatic adjustment means that is controlled by said actuating mechanism.

37. A filling machine according to claim 36, wherein said actuating mechanism is formed by at least one electrically controllable pneumatic valve.

38. A filling machine according to claim 18, wherein a filling phase for a respective filling station is automatically initiated when a container is present if said filling station has reached a specific angular position during rotation of said rotating machine component.

* * * * *